US007124803B2

(12) United States Patent
Jin et al.

(10) Patent No.: US 7,124,803 B2
(45) Date of Patent: Oct. 24, 2006

(54) VENETIAN BLIND MOUNTED IN DOUBLE GLAZING UNIT AND A SLIDING BLOCK THEREFOR

(76) Inventors: Renzhe Jin, 8-2-11, Jingmianli, Development Zone, Qinhuangdao (CN) 066004; Chengzhe Jin, 8-2-11, Jingmianli, Development Zone, Qinhuangdao (CN) 066004

( * ) Notice: Subject to any disclaimer, the term of this patent is extended or adjusted under 35 U.S.C. 154(b) by 145 days.

(21) Appl. No.: 10/746,835

(22) Filed: Dec. 24, 2003

(65) Prior Publication Data

US 2004/0211528 A1 Oct. 28, 2004

(30) Foreign Application Priority Data

Apr. 22, 2003 (CN) ..... 03 2 38471

(51) Int. Cl.
*E06B 3/50* (2006.01)

(52) U.S. Cl. ..... 160/107; 160/168.1 R

(58) Field of Classification Search ..... 160/168.1 R, 160/176.1 R
See application file for complete search history.

(56) References Cited

U.S. PATENT DOCUMENTS 2,389,956 A * 11/1945 Castilonia ..... 160/172 R
3,443,624 A * 5/1969 Toth ..... 160/107
4,817,698 A * 4/1989 Rossini et al. ..... 160/107
5,396,944 A 3/1995 Rossini
5,671,793 A * 9/1997 Lee ..... 160/168.1 R
6,601,633 B1 * 8/2003 Sun et al. ..... 160/107
6,644,376 B1 * 11/2003 Wielen ..... 160/176.1 R
6,817,401 B1 * 11/2004 Sun et al. ..... 160/107
2004/0226665 A1 * 11/2004 Berger ..... 160/107

FOREIGN PATENT DOCUMENTS

CN 2232968 Y 8/1996
CN 2326718 Y 6/1999
WO WO-02/01034 5/2003

* cited by examiner

*Primary Examiner*—Blair M. Johnson
(74) *Attorney, Agent, or Firm*—Madson & Austin

(57) ABSTRACT

A venetian blind provided in double glazing unit, which is mounted in a space defined by two sheets of glass, side frames, a top frame and a bottom frame, the venetian blind comprising a blind body composed of a counterweight, a long axis and a plurality of leaves, a driving unit, and two magnets, one of which being fixed to said sliding block and the other one being located outside the double glazing unit. The venetian blind could be lifted and deflect by the linear movement or rotation of the two magnets, one of which is inside the double glazing unit and the other one is outside the double glazing unit in the case that the double glazing unit is completely sealed. The venetian blind of the present invention is simple in structure and convenient for operating.

10 Claims, 5 Drawing Sheets

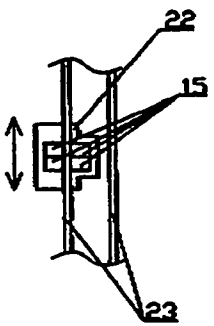
Fig.1A
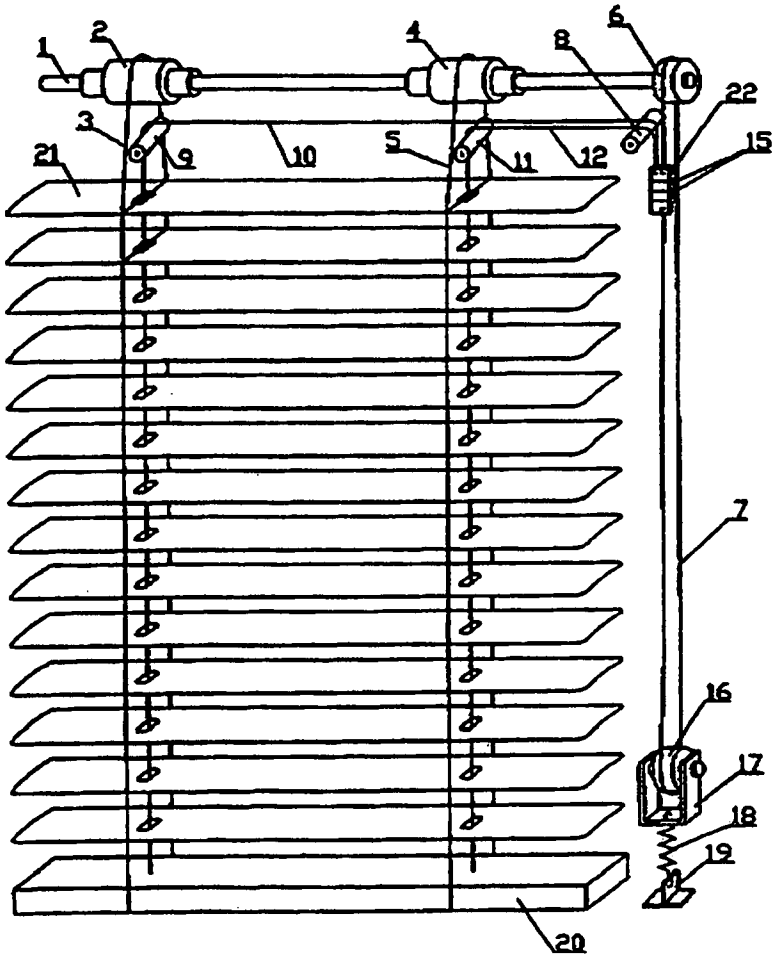
Fig.1
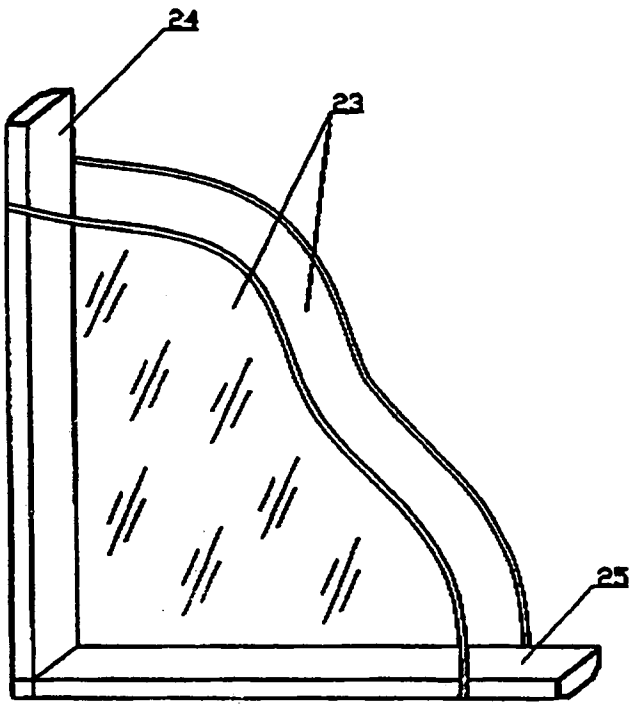

VENETIAN BLIND MOUNTED IN DOUBLE GLAZING UNIT AND A SLIDING BLOCK THEREFOR

TECHNICAL FIELD

The present invention relates to a venetian blind, more particularly, to a venetian blind mounted in a double glazing unit, and the present invention also relates to a sliding block for the venetian blind provided in a double glazing unit.

BACKGROUND ART

For purpose of environmental protection and energy saving, the double glazing unit is widely used in the world because of its particular heat insulating performance, sound insulating performance, glazed frost proof, dust and pollution proof and so on, after more than one hundred year's development. For example, the related laws in Germany stipulate that all the buildings must adopt double glazed window, the conventional windows formed by general glass are forbidden. In North America regions, 95 percent of windows adopt double glazing. With the improvement of the standard of living, the double glazing is rapidly and widely developed in China in recent years. Since the double glazing is formed mainly by transparent glass used for door and window, the transparent window should be provided with various curtains for shielding light and blinding line of sight. However, the curtains provided outside the window tend to be contaminated and damaged, in addition, it is very trouble to wash the contaminated curtains regularly. There is a gap between two sheets of glass of a double glazed window, so that the venetian blind could be fixed in the gap between the two sheets of glass, one obvious advantage thereof is that not only the light can be adjusted but also the venetian blind can be kept clean permanently. Because of the above, the double glazed unit provided with adjustable blind is developed rapidly in the world, for example, double glazing units provided with adjustable blind, which are manufactured by NORDICON Corporation of Denmark and UNICEL Corporation of Canada, are available in the market and used widely for various doors, windows, glass walls and glass roofs. However, in the above double glazing units, since the blind is adjusted directly by mechanical drive, the problem occurs in seal of the double glazing unit. Though the problem is solved at last, the complex structure and high cost prevent the double glazing unit provided with adjustable blind from being used widely. Chinese Utility Model No. 95229065, entitled "integral door or window sash with lateral blind provided in two sheets of glass thereof", proposes a design in which the two sheets of glass are difficult to be sealed completely. In the designs proposed by Chinese Utility Model No. 9721572 entitled "interbedded telescoping blind driven by magnetism", Chinese Utility Model No. 98210257 entitled "completely sealed venetian blind", U.S. Pat. No. 5,396,944 entitled "device for operating a venetian blind or the like placed inside an insulating glass frame", and WO02/01034A1 entitled "manufacturing method of magnetic drive system used for adjustable venetian blind provided in double glazing or pair glass", though the complete seal problem of the double glazing or pair glass is solved by using magnetic drive, the structures of such designs are complex and inconvenient for application.

SUMMARY OF THE INVENTION

Accordingly, an object of the present is to provide a venetian blind provided in double glazing unit, lifting and deflecting of the leaves of the blind can be controlled at the same time by one magnet mounted inside the double glazing unit, The venetian blind of the present invention is simple in structure and convenient for operating, and also the complete sealing is realized.

Another object of the present invention is to provide a sliding block for a venetian blind provided in a double glazing unit, there is provided a roller on a surface of the sliding block, so that the contact between the surface of the sliding block and the glass and/or a side frame of the double glazing unit is rolling contact, therefore, a friction force of the sliding block is reduced when the sliding block is moved, and abrasion of the sliding block is also decreased. The sliding block is more durable, an operation of the Venetian blind provided in double glazing unit is easy and reliable.

Additional objects and advantages of the invention will be set forth in part in the description which follows and, in part will be apparent from the description, or may be learned by practice of the invention.

In order to achieve the above and/or other objects, according to one aspect of the present invention, there is provided a venetian blind provided in double glazing unit, which is mounted in a space defined by two sheets of glass, side frames, a top frame and a bottom frame, comprising: a blind body including a counterweight, a long shaft, a plurality of leaves, and a plurality of turning ropes fitting over said long shaft and being connected to front and rear edges of said leaves respectively, two ends of each turning rope being fixed to said counterweight; and a driving unit comprising a plurality of friction pulleys fitting over said long shaft, said counterweigh and leaves being hung from said pulleys through said turning ropes, the number of the friction pulleys being equal to that of said turning ropes, a lifting pull line, one end of the lifting pull line being fixed to a sliding block and the other end thereof being fixed to said counterweight by passing over a guide pulley which is perpendicular to said long shaft and fixed inside the double glazing unit, a turning pulley provided on one end of said long shaft, a turning tension pulley fixed to said bottom frame of the double glazing unit and located below said turning pulley, an endless turning pull line wound around said turning pulley and turning tension pulley tightly, whose length being suitable for just tensioning said turning pulley and turning tension pulley, said sliding block being fixed to said turning pull line, and two magnets, one of which being fixed to said sliding block and the other thereof being located outside the double glazing unit.

When the magnet outside of the double glazing unit moves up and down, through action of the magnetic force line, the magnet inside the double glazing unit moves up and down corresponding to the magnet outside the double glazing unit, so that the sliding block is moved up and down. When the sliding block moves up and down, the lifting pull line drives the counterweight to move up and down, thus actuating the leaves of the blind to overlap each other or to open. At the same time, because the sliding block is fixed to the turning pull line, the turning pulley is driven to rotate through the up and down movement of the turning pull line. Since the turning pulley is coaxial with the friction pulleys, the leaves are deflected to close or extended horizontally to open through drive of the friction action of the friction pulleys.

Since the upward and downward distances moved by the leaves are large, and the deflected distances of the leaves are small, when the leaves move upwardly or downwardly a large distance, skidding occurs between the friction pulleys and the turning ropes, when the top and bottom positions of the leaves are adjusted correctly, the leaves can be adjusted to deflect to close or to extend horizontally to open through adjusting a small upward and downward distance moved by the sliding block.

In the present invention, a moveable pulley and a pulley seat for supporting the moveable pulley can be substituted for the sliding block, one end of the lifting pull line is fixed to the side or top frames of the double glazing unit and the other end thereof is fixed to the counterweight by passing over the moveable pulley and a guide pulley which is perpendicular to the long axis and fixed inside the double glazing unit. The function of the moveable pulley and the pulley seat are corresponding to the sliding block in the first aspect a shaft of the moveable pulley is fixed to the pulley seat, the turning pull line are fixedly connected at both ends thereof to the pulley seat, and the magnet is also fixed to the pulley seat.

In view of extensibility of the turning pull line, in the present invention, end shafts of the turning tension pulley can be fixed in a U-shape tension pulley seat, the turning tension pulley can rotate in the U-shape tension pulley seat freely. A spring is provided between the U-shape tension pulley seat and the bottom frame of the double glazing unit and used for providing tension force between the turning tension pulley and the turning pulley. The preferable mounting manner is that the axial direction of the turning tension pulley is parallel to that of the long shaft and the magnet faces indoor space after the magnet is mounted on the sliding block or the moveable pulley seat.

Preferably, the lifting pull line is fixed to the counterweight by passing through the center of each leaf.

According to another aspect of the present invention, there is provided a venetian blind provided in double glazing unit, which is mounted in a space defined by two sheets of glass, side frames, a top frame and a bottom frame, comprising a blind body including a counterweight, a long shaft, a plurality of leaves, and a plurality of turning ropes fitting over the long shaft and being connected to front and rear edges of each leaf respectively, the two ends of each turning rope being fixed to the counterweight; and a driving unit including a plurality of friction pulleys fitting over the long shaft, the counterweigh and leaves being hung from the pulleys through the turning ropes, the number of the friction pulleys being equal to that of the turning ropes, a lifting pull line, one end of the lifting pull line being fixed to a the sliding block and the other end thereof being fixed to the counterweight by passing over a guide pulley which is perpendicular to the long axis and fixed inside the double glazing unit, a turning pulley provided on one end of the long shaft, a turning tension pulley fixed to the bottom frame of the double glazing unit and located below the turning pulley, an endless turning pull line wound around the turning pulley and turning tension pulley tightly, whose length being suitable for just tensioning the turning pulley and turning tension pulley, and a pulley pull line , one end of that being connected to the sliding block and the other end thereof being fixed to and wound around the turning pulley; and two magnets, one of which being fixed to an axial end surface of the turning tension pulley and the other one being located outside the double glazing unit.

In the present invention, a moveable pulley and a pulley seat for supporting the moveable pulley can be substituted for the sliding block, and wherein one end of the lifting pull line is fixed to the side or top frames of the double glazing unit and the other end thereof is fixed to the counterweight by passing over the moveable pulley and a guide pulley which is perpendicular to the long shaft and fixed inside the double glazing unit, and one end of the pulley pull line is fixed to the pulley seat and the other end thereof is fixed to and wound around the turning tension pulley.

In the venetian blind provided in double glazing unit, end shafts of the turning tension pulley can be fixed in a U-shape tension pulley seat, the turning tension pulley can rotate in the U-shape tension pulley seat freely. A spring is provided between the U-shape tension pulley seat and the bottom frame of the double glazing unit. The preferable mounting manner is that the axial direction of the turning tension pulley is perpendicular to that of the long shaft and the magnet faces indoor space after the magnet is mounted on the turning tension pulley.

Preferably, the lifting pull line is fixed to the counterweight by passing through the center of each leaf.

In the venetian blind provided in double glazing unit according to another aspect of the present invention, the magnet located outside of the double glazing unit is mounted on a rotation shaft of an additional motor. When powered, the motor rotates so as to drive the inside magnet to rotate, thus saving human labor. If a remote control unit is mounted on the motor, the remote control function can be achieved.

The venetian blind provided in double glazing unit according to the first aspect of the present invention differs from that according to the second aspect of the present invention in that the mounting position of the magnet is different. In the venetian blind provided in double glazing unit according to the second aspect of the present invention, the magnet is mounted on an axial end surface of the turning tension pulley and not on the sliding block or the moveable pulley. When the magnet outside of the double glazing unit moves, the magnet inside of the double glazing unit is driven to rotate through the action of magnetic force lines and the turning tension pulley is also actuated to rotate. The turning pulley and the long shaft are rotated through the turning pull line so as to deflect the leaves to close. Since the pulley pull line is fixed at one end thereof to the turning tension pulley and can be wound on the turning tension pulley during rotation of the turning tension pulley, so that the sliding block or the moveable pulley is driven to move up and down, and the lifting pull line is also driven so as to move the counterweight up and down, thus achieving the purpose of controlling the leaves to move up and down.

According to another aspect of the present invention, there is provided a sliding block for a venetian blind provided in double glazing unit, comprising: a main body having substantively a U-shaped cross section and two extension portions extended outwardly from two sides of a U-shaped recess of the main body respectively, magnets of the venetian blind being mounted in U-shaped recess of the main body; and a first roller provided on a main surface of the extension portions, an axial direction of the first roller being substantively parallel to a width direction of the main surface.

Preferably, there are provided two first rollers on the main surface of the extension portions.

Further, the two first rollers are provided on two sides of the U-shaped recess along a length direction of the main body respectively.

Preferably, a second roller is provided on one side of an extension portion, an axial direction of the second roller is substantively perpendicular to the main surface of the extension portions.

Preferably, there are provided two second rollers on the one side of the extension portions.

Further, the two second rollers are provided on two sides of the U-shaped recess along a length direction of the main body respectively.

Moreover, the two extension portions, the two first rollers, and the two second rollers are symmetrical with respect to a transverse central line of the U-shaped recess, respectively.

Further, a portion of an external end of one extension portion becomes thinner, and a through hole is provided on the thinner portion for connecting to a moveable pulley of the venetian blind via a connection member.

Preferably, the two extension portions are are symmetrical with respect to a transverse central line of the U-shaped recess.

Further, a second roller is provided on one side of an extension portion, an axial direction of the second roller is substantively perpendicular to the main surface of the extension portions.

The advantages of the present invention are that:

1. Only one magnet is provided inside the double glazing unit, and the deflection and upward and downward movement of the leaves can be controlled freely at the same time, so that the structure of the present invention is simple.

2. The moved distance is shortened by half by using a moveable pulley.

3. The deflection and upward and downward movement of the leaves can be remote controlled by using the motor and the remote control unit.

BRIEF DESCRIPTION OF THE DRAWINGS

To help understanding of the present invention, a specific embodiment thereof will now be described by way of example and with reference to the accompanying drawings, in which:

FIGS. 1 and 1A are schematic views of a first preferred embodiment of the present invention;

DETAILED DESCRIPTION OF THE PREFERRED EMBODIMENTS

Figure 2:
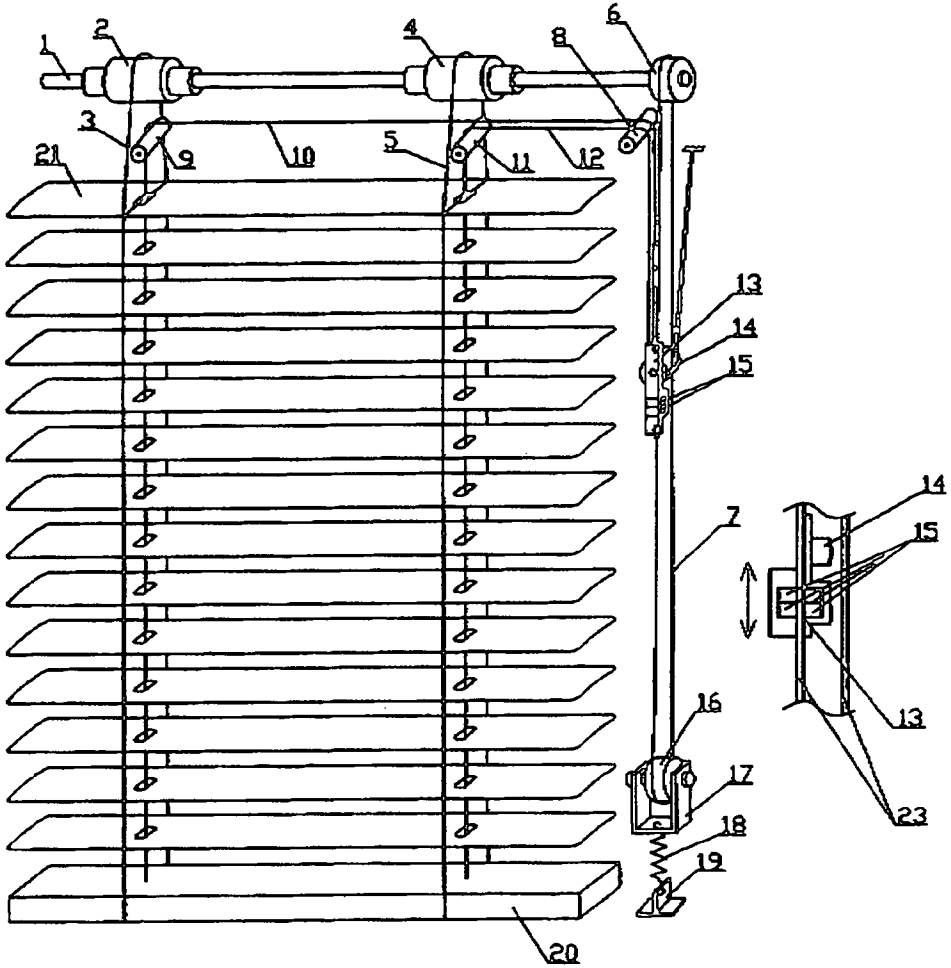
FIG. 2 is a schematic view of a second preferred embodiment of the present invention.
Figure 2:
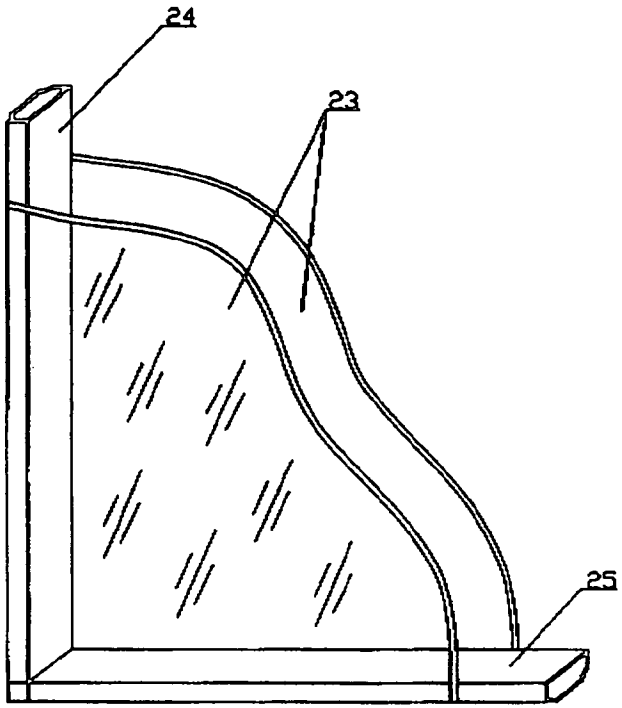

The structure and operation of the venetian blind are described in detail with reference to the drawings and three embodiments of the present invention.

As shown in FIG. 1, a blind provided in the double glazing unit is mounted in a space defined by two sheets of glass 23, side frames 24, a top frame (not shown) and a bottom frame 25, a long shaft 1 of the blind body is fixed to the side frame 24, friction pulleys 2 and 4 are fit over the long shaft 1. Turning ropes 3 and 5 are fixed to front and rear edges of a counterweight 20 and a leaf 21, and hung from the friction pulleys 2 and 4, respectively. A turning pulley 6 is provided at one end of the long shaft 1, and a turning tension pulley 16 is fixed to a bottom frame 25, a turning pull line 7 passes over the turning pulley 6 and the turning tension pulley 16 tightly. One end of each of lifting pull lines 10 and 12 is fixed to a sliding block 22, and the other ends thereof are fixed to the counterweight 20 by passing over guide pulleys 8 and 9 perpendicular to the long shaft 1 and mounted in the double glazing unit. The sliding block 22 is secured to the turning pull line 7. The turning tension pulley 16 is mounted on a tension pulley seat 17, a spring 18 tensions the tension pulley seat 17 and a fixing member 19 mounted on the bottom frame 25. A magnet 15 is fixed to the sliding block 22.

As shown in FIG. 2, a pulley seat 13 and a moveable pulley 14 are provided so as to substitute the sliding block 22 of the first embodiment shown in FIG. 1. In this embodiment, one end of the turning pull line 7 is connected to the pulley seat 13 and the other end thereof runs downwardly, passes over the turning tension pulley 16 and then runs upwardly and passes over the turning pulley 6, at last, the other end of the turning pull line 7 extends downwardly and also be connected to the pulley seat 13. One end of each of lifting pull lines 10 and 12 passes over the moveable pulley 14 and then is connected to a side frame or top frame of the double glazing unit, and the other end thereof passes over guide pulleys 8, 9 and 11 which are perpendicular to the long shaft 1 and mounted in the double glazing unit, then is connected to the counterweight 20. The sliding distance of pulley seat 13 and the moveable pulley 14 is shortened by half because of provision of the moveable pulley 14. The other structures of the second embodiment shown in FIG. 2 are identical with that shown in FIG. 1, so that the descriptions thereof are omitted.

Figure 3:
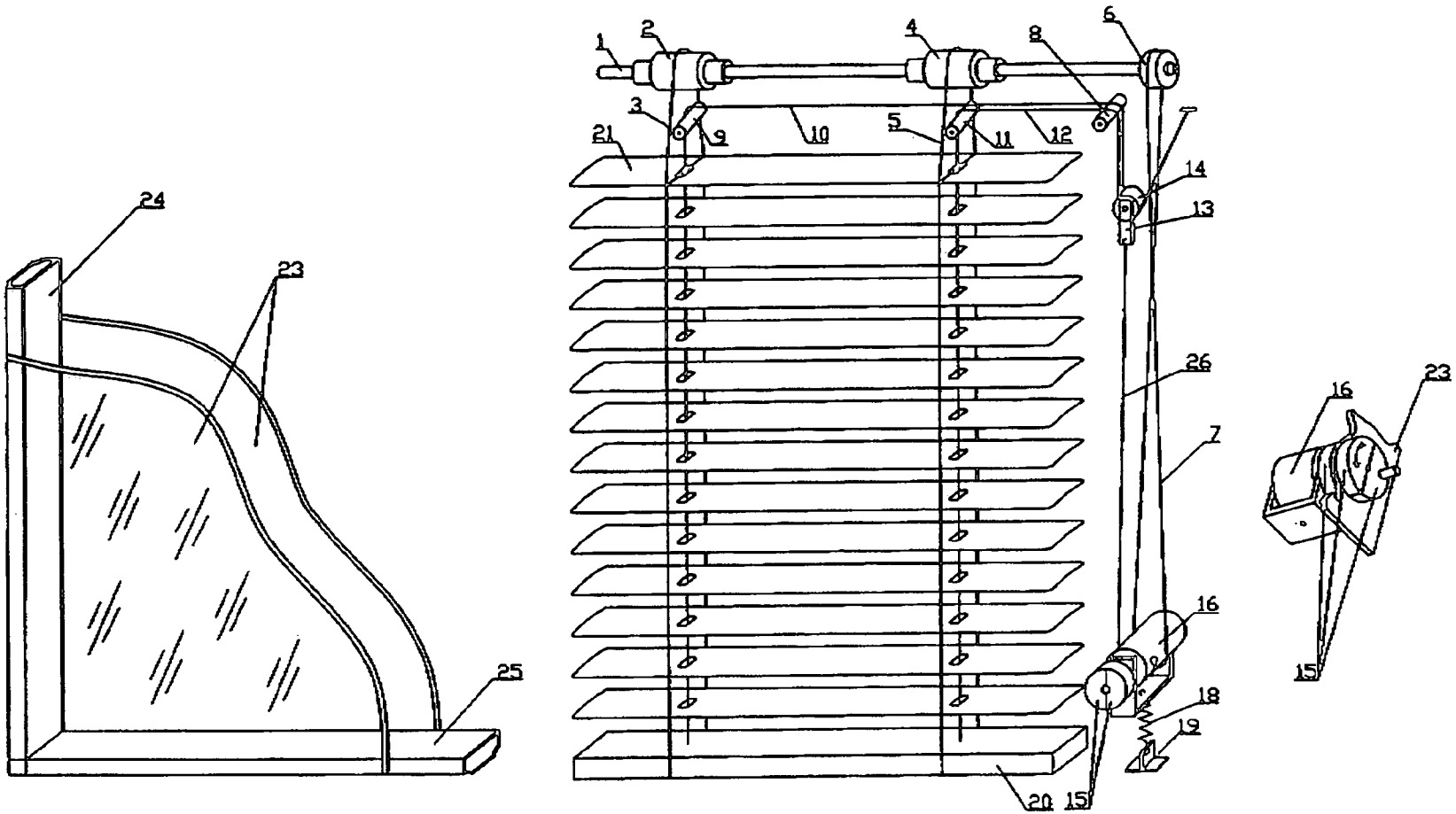
FIG. 3 is a schematic view of a third preferred embodiment of the present invention.

As shown in FIG. 3, by comparison with the second embodiment shown in FIG. 2, a pulley pull line 26 is provided additionally, and the form and mounting position of the magnet 15 and the winding manner of the turning pull line 7 are also different from that shown in FIG. 2. The turning tension pulley 16 functions to turn the direction and winding the pulley pull line 26. The magnet 15 does not reciprocate up and down but winds the pulley pull line 26 around the turning tension pulley 16 through rotation, so that the moveable pulley 14 and the pulley seat 13 are moved up and down by the pulley pull line 26 so as to lift and deflect the leaf of the blind.

In a same way as that of substituting the moveable pulley 14 and the pulley seat 13 in the second embodiment shown in FIG. 2 for the sliding block 22 in the first embodiment shown in FIG. 1, the moveable pulley 14 and the pulley seat 13 shown in FIG. 3 can be replaced by a slide block, and the one end of each of the lifting pull lines 10 and 12 that is fixed to the pulley seat 13 will be fixed to the sliding block 22 and one end of pulley pull line 26 that is fixed to the pulley seat 13 will be fixed to the sliding block 22.

Figure 4:
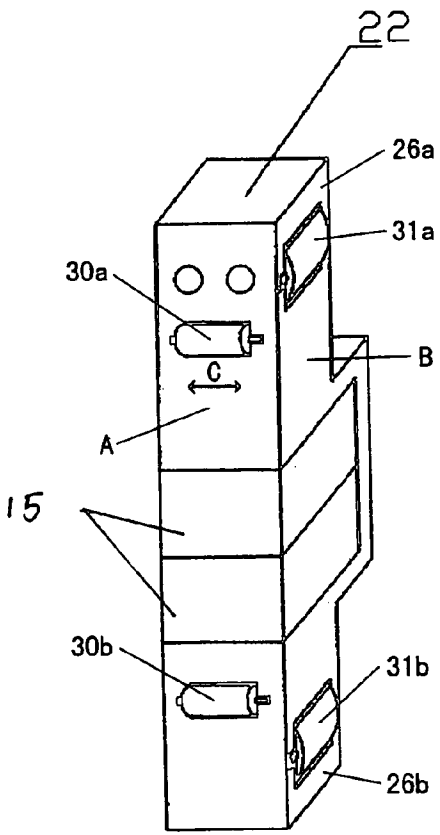
FIG. 4 is a perspective view of a sliding block according to a first embodiment of present invention.

The first embodiment of the sliding block 22 is described with reference to FIG. 1 and FIG. 4. As shown in FIG. 4, the sliding block 22 comprises a main body having substantively a U-shaped cross section, and two extension portions 26*a* and 26*b* extended outwardly from two sides of a U-shaped recess of the main body respectively, magnets 15 of the venetian blind are mounted in U-shaped recess of the main body. There are provided two first rollers 30*a* and 30*b* on a main surface A of the extension portions 26*a* and 26*b*, axial directions of the two first rollers 30*a* and 30*b* are substantively parallel to a width direction C of the extension portions 26*a* and 26*b*. Preferably, two first rollers 30*a* and 30*b* are symmetrical with respect to a transverse central line of said U-shaped recess along a length direction of the main body. There are also provided another two second rollers 31*a* and 31*b* on one side B of the extension portions 26*a* and 26*b*, axial directions of the second rollers are substantively perpendicular to the main surface A of the extension portions 26*a* and 26*b*. Since there are provided two rollers on the main surface A and the side B respectively, when the magnets outside of the double glazing unit are moved up and down, the magnets 15 mounted in the U-shaped recess of the sliding block 22 is driven to move up and down, so as to drive the turning pull line 7 and the lifting pull lines 10 and 12 connected to the sliding block 22 to move, thus causing the blades of the venetian blind to move up and down and/or deflect. Because of the rollers on the main surface A and the side B, the sliding block 22 rolls on the glass and the side frame of the double glazing unit, so that the friction forces therebetween is small, and the abrasion is reduced, thus increasing the durability of the sliding block 22, at the same time, the glass and the side frame of the double glazing unit will not be scuffed by the sliding block 22. In addition, the operation of the venetian blind is easy and reliable.

Figure 5:
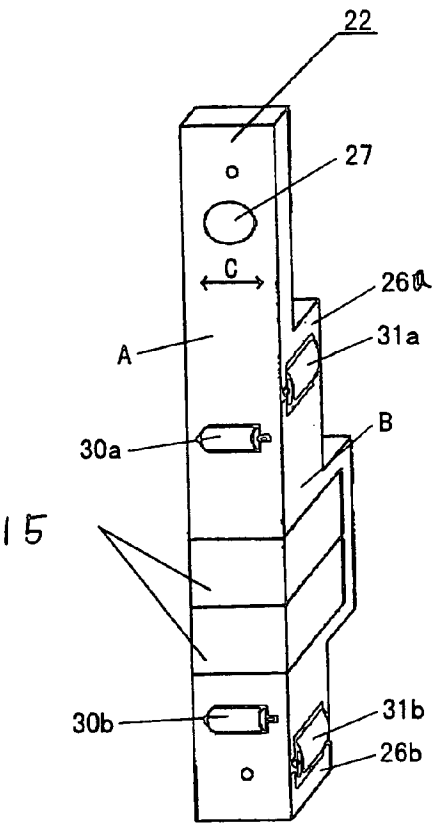
FIG. 5 is a perspective view of a sliding block according to a second embodiment of present invention.

Further, the second embodiment of the sliding block of the present invention is described with reference to FIG. 2 and FIG. 5. As shown in FIG. 5, the sliding block 22 comprises a main body having substantively a U-shaped cross section, and two extension portions 26*a* and 26*b* extended outwardly from two sides of a U-shaped recess of the main body respectively. There are provided two first rollers 30*a* and 30*b* on a main surface A of the extension portions 26*a* and 26*b*, axial directions of the two first rollers 30*a* and 30*b* are substantively parallel to a width direction C of the extension portions 26*a* and 26*b*. The two first rollers 30*a* and 30*b* are symmetrical with respect to a transverse central line of said U-shaped recess along a length direction of the main body. There are also provided another two second rollers 31*a* and 31*b* on one side B of the extension portions 26*a* and 26*b*, axial directions of the second rollers are substantively perpendicular to the main surface A of the extension portions 26*a* and 26*b*. In addition, an end portion of the extension portion 26*a* becomes thinner, and a through hole 27 is provided on the thinner end portion along a width direction of the extension portion 26*a*, the through hole 27 is used for mounting the moveable pulley 14 of the venetian blind on the sliding block 22 through a connection member. In the present embodiment, one end of the turning pull line 7 is connected to the sliding block 22 and the other end thereof runs downwardly, passes over the turning tension pulley 16 and then runs upwardly and passes over the turning pulley 6, at last, the other end of the turning pull line 7 extends downwardly and also be connected to the sliding block 22. One end of each of lifting pull lines 10 and 12 passes over the moveable pulley 14 and then is connected to a side frame of the double glazing unit, and the other end thereof passes over guide pulleys 8, 9 and 11 which are perpendicular to the long shaft 1 and mounted in the double glazing unit, then is connected to the counterweight 20. The sliding distance of the sliding block 11 is shortened by half because of provision of the moveable pulley 14. The other structures of the second embodiment shown in FIG. 5 are identical with that shown in FIG. 4, so that the descriptions thereof are omitted.

It should be noted that the first rollers provided on the main surface A could be one, or three, four, etc. Also, the second rollers provided on the side B could be one, or three, four, etc. In addition, the roller can be only provided on one of the main surface and the side.

Although a few embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A venetian blind provided in a double glazing unit, which is mounted in a space defined by two sheets of glass, side frames, a top frame and a bottom frame, comprising:

a blind body including a counterweight, a long shaft, a plurality of leaves, and a plurality of turning ropes, said turning ropes fitting over said long shaft and being connected to front and rear edges of said leaves respectively, and two ends of each turning rope being fixed to said counterweight; and a driving unit, comprising:

a plurality of friction pulleys fitting over said long shaft, said counterweight and leaves being hung from said pulleys through said turning ropes, the number of the friction pulleys being equal to that of said turning ropes;

a lifting pull line, one end of the lifting pull line being fixed to a sliding block and the other end thereof being fixed to said counterweight by passing over a guide pulley which is perpendicular to said long shaft and fixed inside the double glazing unit;

a turning pulley provided on one end of said long shaft;

a turning tension pulley fixed to said bottom frame of the double glazing unit and located below said turning pulley;

an endless turning pull line winded around said turning pulley and turning tension pulley tightly, whose length being suitable for just tensioning between said turning pulley and turning tension pulley;

said sliding block being fixed to said turning pull line; and two magnets, one of which being fixed to said sliding block and the other thereof being located outside the double glazing unit wherein movement of said outside magnet moves said sliding block.

2. A venetian blind provided in a double glazing unit, which is mounted in a space defined by two sheets of glass, side frames, a top frame and a bottom frame, comprising:

a blind body including a counterweight, a long shaft, a plurality of leaves, and a plurality of turning ropes, said turning ropes fitting over said long shaft and being connected to front and rear edges of said leaves respectively, and two ends of each turning rope being fixed to said counterweight; and a driving unit, comprising:

a plurality of friction pulleys fitting over said long shaft, said counterweight and leaves being hung from said friction pulleys through said turning ropes, the number of the friction pulleys being equal to that of said turning ropes;

a lifting pull line, one end of the lifting pull line being fixed to said side or top frames of said double glazing unit and the other end thereof being fixed to said counterweight by passing over a moveable pulley and a guide pulley which is perpendicular to said long shaft and fixed inside the double glazing unit, said moveable pulley being supported by a pulley seat;

a turning pulley provided on one end of said long shaft;

a turning tension pulley fixed to said bottom frame of the double glazing unit and located below said turning pulley;

an endless turning pull line winded around said turning pulley and turning tension pulley tightly, whose length being suitable for just tensioning between said turning pulley and turning tension pulley, said pulley seat being fixed to said turning pull line; and two magnets, one of which being fixed to said pulley seat and the other thereof being located outside the double glazing unit wherein movement of said outside magnet moves said sliding block.

3. The venetian blind provided in double glazing unit according to the claim 2, wherein a spring is provided between said turning tension pulley and said bottom frame of the double glazing unit.

4. The venetian blind provided in double glazing unit according to the claim 2, wherein said lifting pull line is fixed to said counterweight by passing through the center of each leaf.

5. A venetian blind provided in a double glazing unit, which is mounted in a space defined by two sheets of glass, side frames, a top frame and a bottom frame, comprising:

a blind body including a counterweight, a long shaft a plurality of leaves, and a plurality of turning ropes, said turning ropes fitting over said long shaft and being connected to front and rear edges of said leaves respectively, and two ends of each turning rope being fixed to said counterweight; and a driving unit, comprising:

a plurality of friction pulleys fitting over said long shaft said counterweight and leaves being hung from said pulleys through said turning ropes, the number of the friction pulleys being equal to that of said turning ropes;

a lifting pull line, one end of the lifting pull line being fixed to a sliding block and the other end thereof being fixed to said counterweight by passing over a guide pulley which is perpendicular to said long shaft and fixed inside the double glazing unit;

a turning pulley provided on one end of said long shaft;

a turning tension pulley fixed to said bottom frame of the double glazing unit and located below said turning pulley;

an endless turning pull line winded around said turning pulley and turning tension pulley tightly, whose length being suitable for just tensioning between said turning pulley and turning tension pulley; and a pulley pull line, one end of which being connected to said sliding block and the other end thereof being fixed to and wound around said turning tension pulley; and two magnets, one of which being fixed to an axial end surface of the turning tension pulley and the other one being located outside the double glazing unit wherein rotation of the outside magnet rotates said turning tension pulley.

6. A venetian blind provided in a double glazing unit, which is mounted in a space defined by two sheets of glass, side frames, a top frame and a bottom frame, comprising:

a blind body including a counterweight, a long shaft, a plurality of leaves, and a plurality of turning ropes, said turning ropes fitting over said long shaft and connected to front and rear edges of said leaves respectively, and two ends of each turning rope being fixed to said counterweight; and a driving unit, comprising:

a plurality of friction pulleys fitting over said long shaft, said counterweight and leaves being hung from said pulleys through said turning ropes, the number of the friction pulleys being equal to that of said turning ropes;

a lifting pull line, one end of the lifting pull line being fixed to said side or top frames of said double glazing unit and the other end thereof being fixed to said counterweight by passing over a moveable pulley and a guide pulley which is perpendicular to said long shaft and fixed inside the double glazing unit, said moveable pulley being supported by a pulley seat;

a turning pulley provided on one end of said long shaft;

a turning tension pulley fixed to said bottom frame of the double glazing unit and located below said turning pulley;

an endless turning pull line winded around said turning pulley and turning tension pulley tightly, whose length being suitable for just tensioning between said turning pulley and turning tension pulley; and a pulley pull line one end of which being connected to said pulley seat and the other end thereof being fixed to and wound around said turning tension pulley; and two magnets, one of which being fixed to an axial end surface of said turning tension pulley and the other one being located outside the double glazing unit wherein rotation of the outside magnet rotates said turning tension pulley.

7. The venetian blind provided in double glazing unit according to the claim 6, wherein a spring is provided between said turning tension pulley and said bottom frame of the double glazing unit.

8. The venetian blind provided in double glazing unit according to the claim 6, wherein said lifting pull line is fixed to said counterweight by passing through the center of each leaf.

9. The venetian blind provided in double glazing unit according to the claim 6, said magnet located outside of the double glazing unit is mounted on a rotation shaft of an additional motor.

10. The venetian blind provided in double glazing unit according to the claim 9, wherein a remote control unit is mounted on said additional motor.

* * * * *

UNITED STATES PATENT AND TRADEMARK OFFICE

CERTIFICATE OF CORRECTION

PATENT NO. : 7,124,803 B2
APPLICATION NO. : 10/746835
DATED : October 24, 2006
INVENTOR(S) : Renzhe Jin et al.

It is certified that error appears in the above-identified patent and that said Letters Patent is hereby corrected as shown below:

On page 8, column 3, line 45, please delete "fixed to a the" and replace it with --fixed to a--.

Signed and Sealed this

Seventh Day of August, 2007

JON W. DUDAS
*Director of the United States Patent and Trademark Office*